US005612088A

United States Patent [19]

Zecher

[11] Patent Number: 5,612,088

[45] Date of Patent: Mar. 18, 1997

[54] METHOD FOR THE SURFACE TREATMENT OF PARTS

[76] Inventor: Robert F. Zecher, 556 Woodward Dr., Huntingdon Valley, Pa. 19006

[21] Appl. No.: 444,250

[22] Filed: May 19, 1995

Related U.S. Application Data

[62] Division of Ser. No. 134,315, Oct. 8, 1993, Pat. No. 5,417,829.

[51] Int. Cl.[6] ..... B05D 3/12; B05D 1/40

[52] U.S. Cl. ..... 427/242; 427/327; 427/331

[58] Field of Search ..... 427/242, 327, 427/328, 329, 331; 118/417–418

[56] References Cited

U.S. PATENT DOCUMENTS

| | | | |
|---|---|---|---|
| Re. 30,977 | 6/1982 | Zecher | 51/422 |
| 1,107,464 | 8/1914 | Trout | 118/423 X |
| 2,924,229 | 2/1960 | Kearney et al. | 118/426 X |
| 3,479,200 | 11/1969 | Estabrooks | 118/423 X |
| 3,940,512 | 2/1976 | Christini et al. | 427/242 X |
| 4,137,345 | 1/1979 | Falivene | 118/423 X |
| 4,763,392 | 8/1988 | Fogal et al. | 427/327 |
| 5,114,751 | 5/1992 | Ahmed et al. | 427/242 |
| 5,417,829 | 5/1995 | Zecher | 204/214 |

OTHER PUBLICATIONS

Finmac, Inc. "Rollaveyor™" drawing (undated).

"Spray Thru–High Efficiency Barrel Systems", Hardwood Line Manufacturing Company (3 pages of brochure) (undated).

*Primary Examiner*—Donald R. Valentine

*Attorney, Agent, or Firm*—Synnestvedt & Lechner

[57] ABSTRACT

Conveyors are provided for tumbling and transferring parts to be subjected to treatments, including electroplating in a series of treatment tanks. The conveyors are supported on the treatment tanks for pivotal movement between a position in which the parts are received from a parts feeder to a treatment position in which the parts are subjected to tumbling and immersion within a treatment solution to a drain position for during of the treatment solution and drying and next to a discharge position where they are discharged either to another conveyor in a next treatment tank or to a subsequent station for further processing. Movement of the conveyors to the several positions is carried out by tilt devices which vary the slope of the upper run of each conveyor. A plating tank includes anode baskets disposed adjacent the load-receiving end of the upper run of the conveyor and cathode danglers for contacting the parts on the upper run to establish a current path comprising danglers, the parts, the electrolytic solution and the anodes. Circulation of electrolyte is provided establishing a circulation path past the anodes through an inlet opening in the parts receiving hopper portions of the conveyor.

4 Claims, 5 Drawing Sheets

METHOD FOR THE SURFACE TREATMENT OF PARTS

This is a divisional of application Ser. No. 08/134,315 filed Oct. 8, 1993 now U.S. Pat. No. 5,417,829.

FIELD OF THE INVENTION

This invention relates to the surface treatment of parts, more particularly metal parts and, although not limited thereto, the invention is especially adapted for use in an electroplating system for efficient plating and transportation of the parts to be plated from a parts supply through various pre-treating, plating and post-treatment baths.

BACKGROUND OF THE INVENTION

In the so called batch or barrel plating of metal parts, the parts to be plated are placed in a perforated barrel or basket carried on an overhead track system so as to move the parts from one station to the next. The stations comprise in a general way, a series of tanks containing pre-treatment, plating and post-treatment solutions. At each of the various stations, the barrel or basket of parts is lowered into a particular solution so that procedures such as cleaning, etching, removal of flashing, plating, rinsing and drying can take place.

Various problems exist with barrel plating operations of the kind referred to.

One problem is that in moving a barrel from one treatment station to another, it is next to impossible to control spillage of the treatment solution which drains from and drips off of the barrel as it is removed from the bath and transferred to the next station. In addition, since drainage is relatively slow, the entire process will be slow or else considerable contamination of one bath with the solution from a preceding bath occurs. Of special concern is the dilution of the electrolyte with solution from a preceding bath. In addition, because the barrel must move from one bath of solution to the next by means of a track, it is difficult and expensive to fashion hoods or covers for the baths and, consequently, evaporation of solution and the release of fumes into the atmosphere is difficult to control and is viewed as a significant environmental hazard. Still further, being essentially a batch operation, throughput of parts treated is relatively low. Difficulties in circulation of electroplating solution around the parts being plated exist, and high plating voltages must be used which not only means that the process is relatively inefficient but that anode life is relatively short.

SUMMARY AND OBJECTS OF THE INVENTION

The present invention involves method and apparatus for surface treatment of small objects in general and, in particular, to method and apparatus adapted to treatments such as the electrolytic plating of such objects in a plating system comprising independent tanks or troughs containing treatment solutions necessary for the plating process. The system contemplates the replacement of the conventional barrels or baskets for transporting parts from one treatment bath to the next with individual tumbling conveyors of modified form but of the general type disclosed in my U.S. Pat. No. 4,115,960, granted Sep. 26, 1978 (Reissue U.S. Pat. No. 30,977).

In accordance with the invention, parts receiving tumbling conveyors are positioned within some or all of the treatment tanks within the plating system. As compared with the tumbling conveyors disclosed in U.S. Pat. No. Re. 30,977, each such conveyor is mounted for movement between a raised position where it receives parts, a lowered position where the parts are tumbled within a particular solution during a treatment and additional raised drain and transfer position in which the parts are removed from the solution and may be tumbled and/or transferred to the next station. At the end of a treatment period, the tumbling conveyor shifts to the raised drain position for drainage of solution accompanied by drying in a stream of drying air, if desired, followed by shifting to be transfer position for discharge of the treated parts to a subsequent tank where the parts are received at the input end of a subsequent tumbling conveyor. Adjustment of conveyor belt speed and slope may be provided as may be found necessary during a treatment procedure.

Although equipment for deflashing parts and tanks equipped with conventional conveyors or chutes may be used in some parts of a system, it is preferred that all tanks within the system be equipped with tumbling conveyors of the kind described. It is highly advantageous that conveyor means be provided for transporting and tumbling the parts through each treatment bath. In the bath where plating occurs, an anode and cathode are disposed in relation to the tumbling conveyor so that as the conveyor tumbles the parts within the electrolytic solution, an electric current flows from the anode through the solution to the parts and from thence to a cathode secured to the conveyor and positioned to maintain electrical contact with the parts being tumbled. An important aspect of the tumbling conveyor mounted within the plating bath is that the conveyor surfaces liable to be contacted by the parts within the bath of solution are electrically non-conductive and chemically inert with respect to the solutions contemplated so that plating or corrosion of the conveying equipment does not occur. Preferred methods of operation at the plating station involve the use of cathode danglers spaced above the conveying and tumbling surface and an electrolytic pumping manifold for circulating fresh electrolyte in the region of the tank wherein the parts and the anodes are located.

Objects and advantages of the invention include increased efficiency in the plating of small objects and substantial elimination of spillage and complete recovery of potentially polluting solutions utilized during the plating process. Related objects are the provision of simplified and efficient means for cleaning and promoting uniformity of plating and substantial elimination of cross contamination of cleaning, plating and rinsing solutions. Other objectives include provision of apparatus and method for surface treatment of small objects and, in particular, for plating equipment and method which permits efficient transfer of the objects from one station to the next while accommodating exhaust equipment for removal of noxious fumes and dryers for air drying of treated objects prior to conveyance from a treatment tank. Still further objects involve provision of a system which permits the reduction of anode voltages and disposition of parts to be plated in a region of optimum solution circulation and current density. Additional objects include the achievement of increased anode life and improvements in the circulation of electrolyte.

DETAILED DESCRIPTION OF AN ILLUSTRATIVE EMBODIMENT OF THE INVENTION

Figure 1:
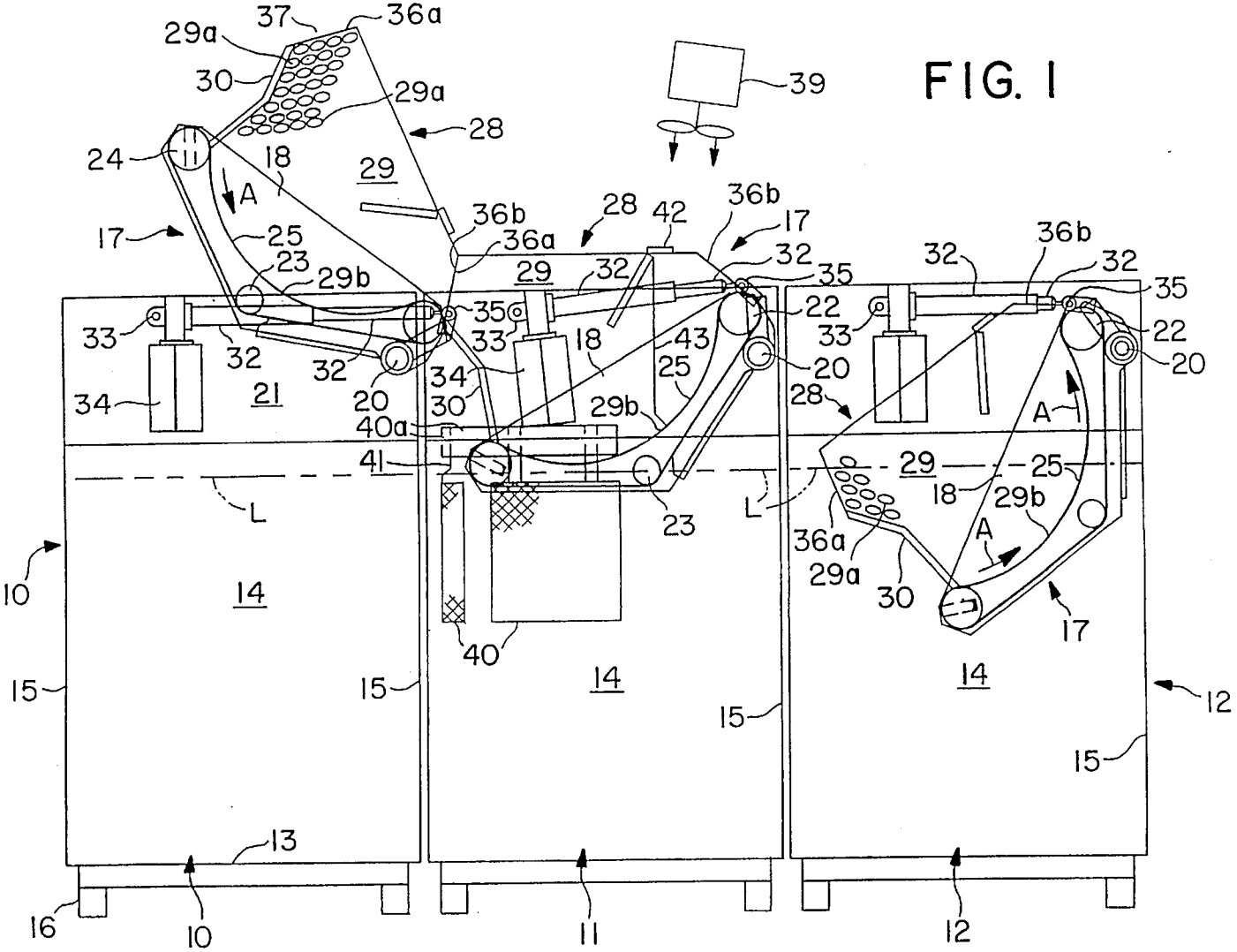
FIG. 1 is a side elevational view of a plating system incorporating the present invention.
Figure 3:
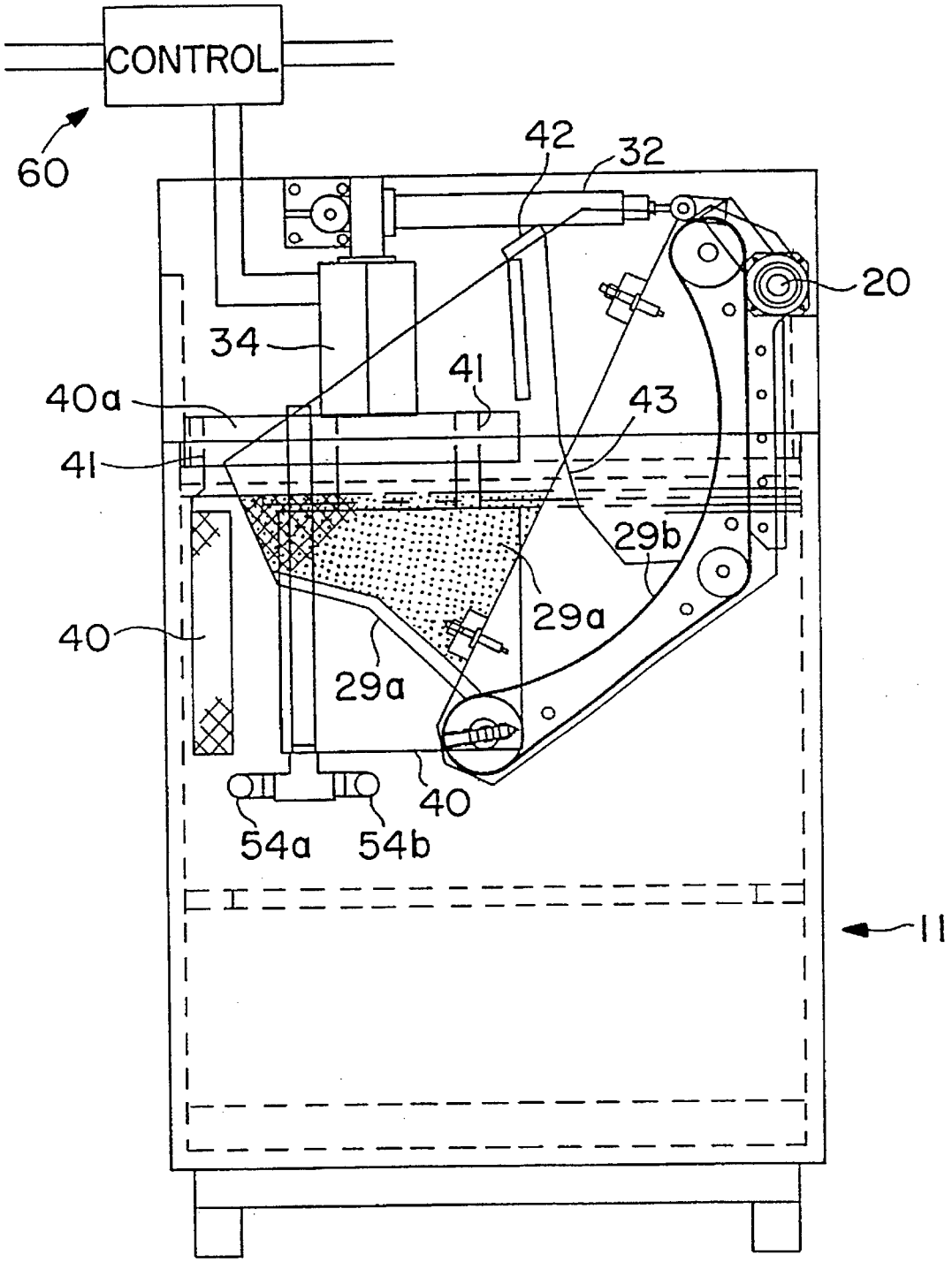
FIG. 3 is a side view of the plating tank of FIG. 2.
Figure 4:
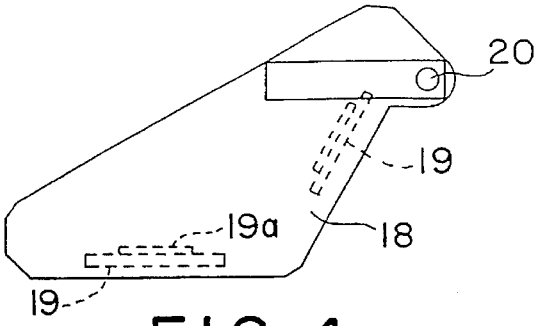
FIG. 4 is a side view of the conveyor frame assembly of a conveyor device utilized in conjunction with the invention.
Figure 5:
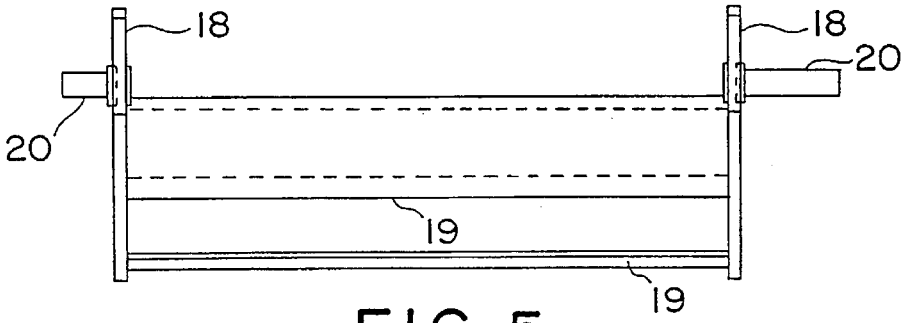
FIG. 5 is an end view of the conveyor frame assembly of FIG. 4.

In describing the invention, reference is first made generally to FIGS. 1 and 3 which illustrate the principles of the invention as applied to a simplified batch plating system. The exemplary plating system of FIG. 1 is comprised of three serially spaced tanks 10, 11 and 12, each intended to contain liquid treatment solution within which batches of the objects, such as small electrical parts to be plated, are serially immersed. Each tank is preferably substantially rectangular in cross section being comprised of a bottom wall 13, side walls 14 and end walls 15. The tanks are typically opened at the top, although hoods or exhaust systems for removal of toxic vapors are desirably provided for any tank having a solution with volatile components. In a typical system, the tanks are mounted on pallets 16 so that they can be easily moved by a forklift or similar device.

In the exemplary system, tank 10 is filled with one of a number of known cleaning or rinsing solution, which is provided as a pre-treatment for objects to be plated. Additional pre-treatment tanks and/or other equipment may be provided for the purpose of surface treatment, such as equipment for tumbling and blasting or tanks for etching in an acid bath to enhance the plating effectiveness and for the rinsing of the objects in a rinsing solution for the removal of surface contaminants or an etchant and/or cleaning solution as may be required. Means are provided for circulation, as well as addition of and drainage of the solutions within the cleaning or other pre-treatment tanks.

In the preferred embodiment of the invention, the plating tank and, more preferably, the several pre- and post-treatment tanks are each provided with a continuous belt, tiltable conveyor and tumbling device of a type similar to the conveyor device disclosed in my prior U.S. Pat. No. 4,115,960, reissued as U.S. Pat. No. Re. 30,977 on Jun. 22, 1982.

Figure 2:
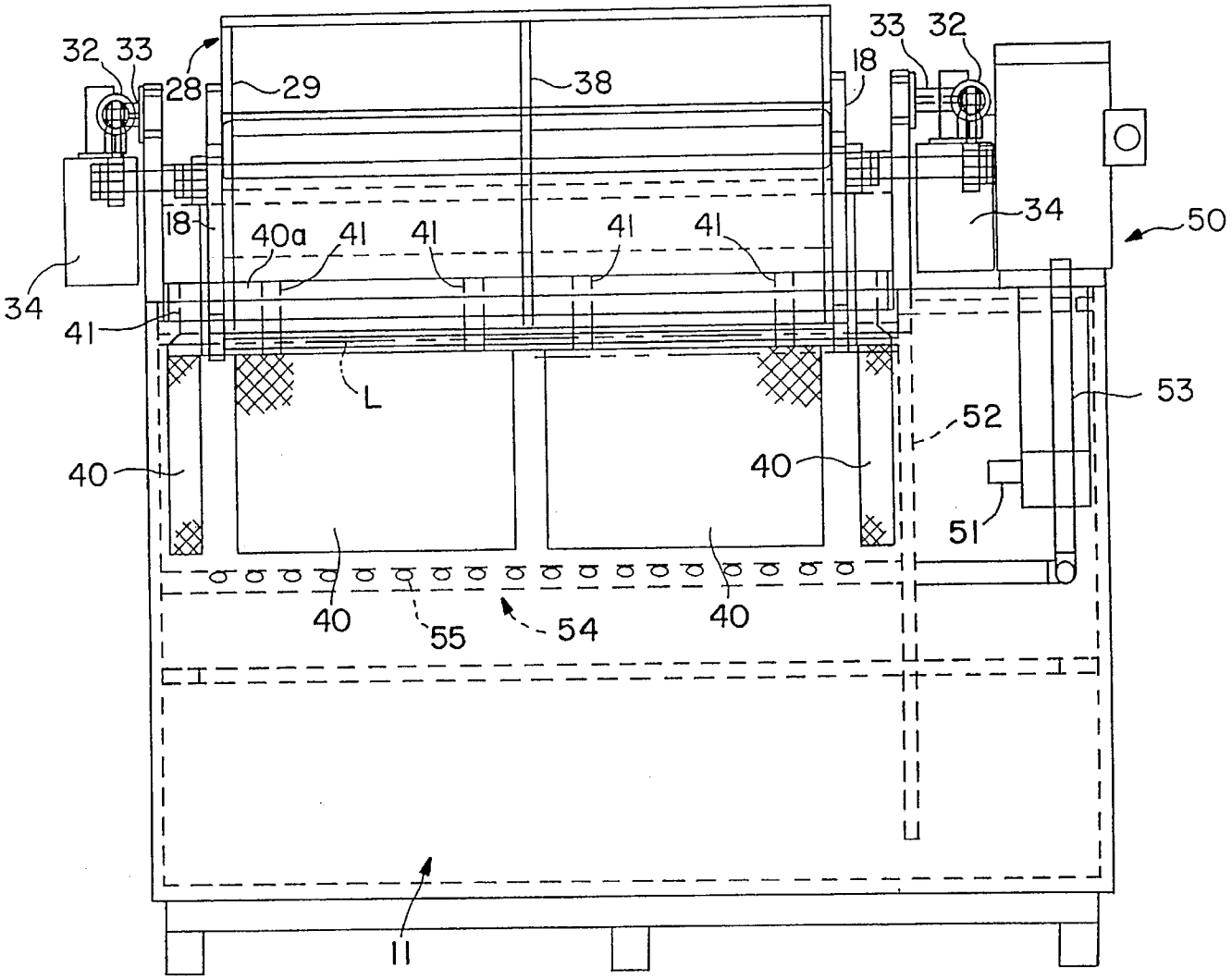
FIG. 2 is an end view of a plating tank used in the plating system of FIG. 1.
Figure 6:
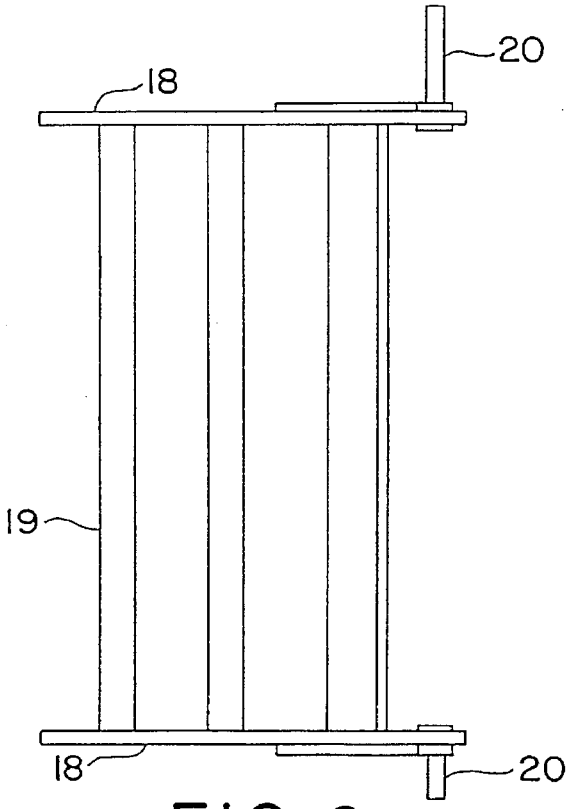
FIG. 6 is a plan view of the conveyor frame assembly of FIGS. 4 and 5.

With reference first to FIGS. 1 and 4–9, there is illustrated a plating system incorporating conveyor devices for tumbling and transferring small objects in accordance with the invention. In general, each of the conveyor devices has a flexible continuous belt having an upper run on which batches of parts are deposited. The upper run has a generally concave contour and is tiltable upwardly into a position in which advancement of the belt in the direction of arrow "A" causes a tumbling of the objects on its surface. In preferred form, each conveyor device, generally indicated at 17, comprises a pair of parallel side frame plates 18 joined together by suitable cross bars 19 (FIG. 6). Coaxially aligned stub shafts 20 project outwardly from the side frame plates 18 and provide a pivotal mounting means for pivotally mounting each conveyor device on side plates 21 which are suitably supported on the side walls of each of tanks 10–12 (FIGS. 1 and 2). Also carried by the side frame plates 18 is a belt drive roller 22 and a pair of spaced apart idler rollers 23 and 24 which support and guide the conveyor belt 25 which is of relatively open or porous construction. Drive roller 22 is preferably a motorized roller of the Power Moller® type supplied by Itok Electric Company, Ltd. of 1146-2 Asazuma-Cho, Kasai, Hyogo 679-01, Japan and utilizes an electric motor, not shown, mounted internally of the rotor.

Figure 8:
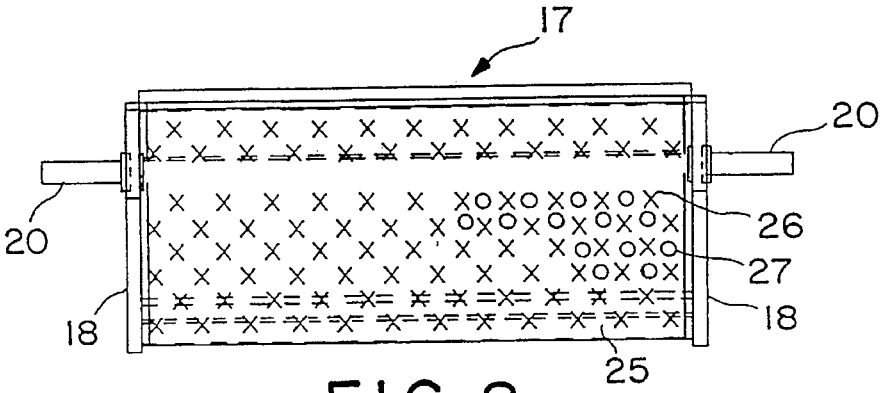
FIG. 8 is a front view of the conveyor device of FIG. 7.
Figure 9:
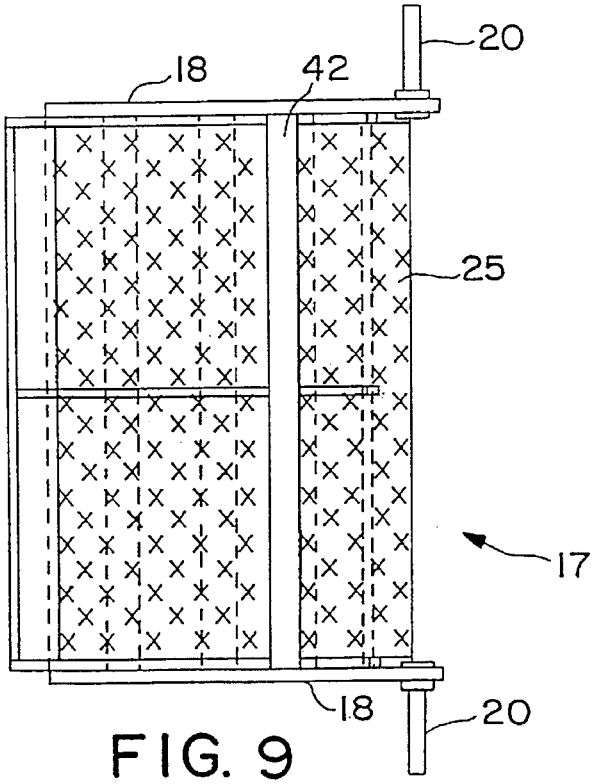
FIG. 9 is a top view of the conveyor device of FIGS. 7 and 8.

For reasons to be described hereinafter, conveyor belt 25 is formed of an electrically non-conductive material, for example, a flexible polyester, in woven form. The belt is preferably provided with a polyurethane covering on which flexible projections indicated by the "X" marks in FIGS. 8 and 9 are provided. Spaced apart perforations 27, a representative number of which are shown in FIG. 8, are uniformly distributed over the belt surface, to allow for a free passage of treatment solution.

Figure 7:
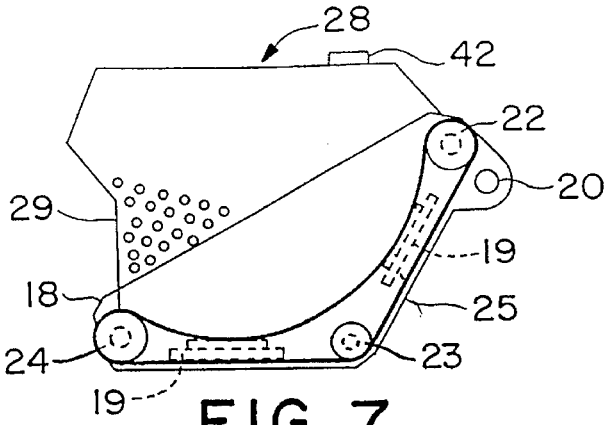
FIG. 7 is a view similar to FIG. 4 showing the assembled conveyor device.

As can be seen in FIGS. 1 and 7, the rollers 22 are mounted in an offset relationship with respect to the axis of rotation of stub shafts 20. Idler rollers 23 and 24 are mounted so as to allow the upper run of the conveyor belt to follow a generally concave profile, as viewed in FIGS. 1 and 7.

In carrying out the invention, each conveyor device is desirably provided with an open hopper 28 which serves to receive and contain a batch of objects being treated on the surface of the upper run. Each hopper 28 is provided with side walls 29 secured to the inner surface of each side frame plate 18 and a front end wall 30 disposed at its loading end. As seen in FIGS. 1 and 3, the side walls and the front end wall are perforated, as shown at **29*a*, to facilitate circulation and drainage of solution. As in the units described in U.S. Pat. No. Re. 30,977, the side walls are preferably formed with curved lower edges 29*b* which constrain the upper run of each conveyor belt to follow the concave contour. The end wall 30 at the load receiving end of each hopper terminates short of side walls 29 so that a relatively large open area 37** is formed. This opening permits easy loading and facilitates circulation of solution, as will be explained hereinafter.

In accordance with the invention, means are provided for angularly disposing each conveyor unit in any one of a plurality of positions within the tanks 10–12, as illustrated in the three tanks of FIG. 1. Preferably, this means comprises extendable actuators 32 pivotally mounted on plates 21 at 33 and driven by electric motors 34 through a worm and gear, not illustrated. The actuator 32 is rotatably affixed to one side frame member on transverse axis 35 spaced generally above an axis extending through stub shafts 20 and is extendable and retractable by operation of motor 34.

In general, actuators 32 constitute means for the pivotal rocking of each conveyor unit to a first, raised position in which the actuator is fully extended, as shown in the left-hand tank 10, to a second or intermediate position, shown in the center tank 11, and finally a third or treatment position, as shown in tank 12 of FIG. 1. On account of the offset location of axis 35 in relation to the axis of the stub shafts 20, the discharge end of the conveyor extends over the edge of its tank to a position overlying the next adjacent tank when the conveyor is in the first, raised position allowing parts advanced on the upper run of the conveyor to be deposited on a receiving conveyor which is positioned in the second position, as illustrated in tank 11, by the pivotal rocking means for that tank. When the actuator is fully retracted, which is the position illustrated in tank 12 in FIG. 1, the parts are fully immersed in the solution within the tank. The approximate level of solution within the tanks is indicated by broken line "L" in FIG. 1.

As further illustrated in FIG. 1, the ends of side walls 29 of hopper 28 have an angled profile, as shown at 36*a* and 36*b*, to provide that when a first conveyor device is located in the first, raised position, as illustrated in the view of the left-hand tank of FIG. 1 and the second conveyor device is in the second or intermediate position in which parts are received, as illustrated in the center tank of FIG. 1, the edges 36*a* and 36*b* of the respective rear and front ends of the hopper side walls of adjacent conveyor units adjoin one another to form a continuous wall surface which serves as a guide means for the parts as they are passed from the surface of one conveyor device to the next. In addition, the top edge of front end wall 30 of the hopper for a second conveyor device will be positioned just adjacent the discharge end of the belt of a first conveyor unit, thereby assuring a smooth and an unrestricted passage of parts from one conveyor to the next.

Still further and as best shown in FIG. 2, the hoppers 28 are preferably divided by means of one or more partitions 38, which extend lengthwise of the upper run of each conveyor and serve as a means for confining a batch of parts to a smaller area when smaller batches of parts are being processed.

In the operation of the equipment so far described, a conveyor unit receives parts when in the second or intermediate position, as shown in tank 11 in FIG. 3. A suitable load of parts is deposited onto the upper run of conveyor belt 25 by deposit through the relatively large opening 37 at the loading end of a hopper 28. Once the parts are deposited on the upper run of conveyor belt 25, the conveyor unit is lowered to the third or treatment position by retraction of actuator 32 so that the upper run slopes steeply upwardly and the parts are totally immersed within the liquid solution within the particular tank in which the conveyor unit is mounted, as is seen for example in the view of tank 12. Advancement of the upper run of the conveyor belt 25 in the direction of arrow "A" causes a tumbling of the parts within the hopper and assures that all surfaces of all parts on the belt are completely and continuously exposed to the treatment solution. Tumbling is facilitated by the projections on the belt 25 which act to draw the parts up the relatively steep slope before they fall back towards the loading end of the upper run.

Following a period of tumbling in any particular tank, the actuator 32 is again partially extended to the second or intermediate position to allow for drainage of solution, as illustrated in FIG. 1 by conveyor device 17 within tank 11. In this position, the parts may be further tumbled by advancement of conveyor belt 25. The surface of the upper run of the conveyor belt in the second position is well above the liquid level within the tank, and the conveyor is desirably maintained in this position with optional tumbling of the parts for a period of time to allow the solution to drain through the perforations 29*a* in the hopper and perforations 27 in the belt. If desired, an air blower 39 is positioned above any treatment tank to direct a flow of drying air downwardly onto the parts so as to further facilitate the removal of treatment solution.

The first or discharge position of each conveyor unit is with actuator 32 fully extended, as can be seen at the left-hand side of FIG. 1. In this position, the conveyor is fully elevated with its input end raised relatively to its discharge end and its discharge end extending out of the tank in which it is mounted into the next tank. In this position, advancement of the conveyor belt in the direction indicated by arrow "A" causes the parts to be discharged either directly into a conveyor unit in the next tank, as shown in FIG. 1, or if the last conveyor unit in a series is in such position, the parts are discharged from the system to other handling equipment, not shown.

As indicated above, the preferred mode of operation contemplates that tank 11 of FIG. 1 be equipped for electroplating of the parts passing through the treatment system. For this purpose, anode means, which preferably comprises a plurality of anode baskets 40, are provided. As can be seen in FIGS. 1–3, the anode baskets 40 are suspended by means of spaced hangers 41 suspended from a bus bar 40*a* mounted adjacent the input end of each tank. In the preferred embodiment, the anode material within baskets 40 comprises sintered nuggets or balls of the plating metal. As is understood by those of ordinary skill in the art, the baskets are typically formed of titanium metal or stainless steel, although plastic materials may be suitable for the purpose.

Affixed to the top of each of the hopper side walls 29 is a bus bar 42 from which a plurality of spaced apart braided, flexible cathodic elements 43 preferably formed of flexible conductive wire made of copper or aluminum are suspended. These cathodic elements, termed "danglers" by those in the art, are of a length sufficient to establish electrical contact with parts on the conveyor belt as the parts are being tumbled when the conveyor is pivoted to the plating position. In this position, the load of parts is completely immersed within the electrolytic solution. An electrical current path and ion flow is established from anodes 40 through the ions within the solution through the open end of hopper 28 to the parts, thereby effecting plating of all surfaces of the parts as the parts are tumbled. As understood by those in the plating art, all conveyor and hopper parts subject to immersion in the plating solution are either electrically isolated or formed of a plastic or other electrically non-conductive material.

To provide for a continuous circulation of plating solution, the plating tank is preferably provided with a solution pump 50 located at one side having an inlet 51, as best shown in FIG. 2. A baffle 52 is spaced adjacent to pump 50. Solution is drawn over the top of the baffle 52 into inlet 51 and discharged from pump 50 through a discharge pipe 53 to spargers 54. Spargers 54 are disposed adjacent to the anode baskets 40 to direct an upwardly flowing circulation path over the surfaces of the anode baskets to the parts. Spargers 54 preferably include a pair of transversely extending pipes 54*a* and 54*b*, shown in FIGS. 2 and 3. Each sparger has spaced perforations 55 through which the solution is discharged maintaining a constant circulation mixing to maximize the availability of a constant supply of metal ions for plating purposes.

In summary, parts to be plated are first deposited onto the surface of a first conveyor 17 which is located within a pretreatment tank 10 through the rearwardly facing opening in the hopper 28 of that particular conveyor, the conveyor being located in the intermediate or load receiving position which corresponds to the position shown for the conveyor located within tank 11 in FIG. 1. The control means, shown schematically at 60 in FIG. 3, allows for movement of the first conveyor to the position corresponding to the position shown in tank 12 in FIG. 1 in which position the parts are immersed within the solution contained within tank 10. The control means provides for advance of the conveyor belt and a tumbling of the parts being treated for a period of time sufficient to treat the parts as by rinsing in a suitable cleaning solution. At that point, conveyor belt is tilted to the intermediate position shown in tank 11 for a period of time sufficient to permit drainage of solution back into the tank 10. If desired when in this position, an air blower 39 may be used to assist in the removal of the solution. Finally, the control means causes the actuator to move the conveyor to the raised position, as shown in tank 10 of FIG. 1, wherein it is raised by an amount sufficient to transfer the parts to the conveyor in tank 11 upon advance of the conveyor belt 25. Following deposit of all parts on the upper run of second conveyor belt 25, the first conveyor 17 is returned to the position corresponding to the position shown for the conveyor in tank 11 for receipt of the next load of parts. The conveyor in the second tank 11 is lowered so that the parts are totally immersed in the electrolyte and are subjected to a tumbling action. As the parts are tumbled, they are contacted by the cathode danglers 43 and a electric current path is established from anodes 40 to the cathode danglers 43 causing deposit of metal ions onto the surface of the parts as they are tumbled. Following plating, the second conveyor is elevated to the intermediate position shown for drainage and drying prior to movement to the elevated discharge position where they are ready to be deposited onto the surface of the conveyor in the third tank 12. The sequence of operations in the third tank is essentially the same as that described above with respect to the first two tanks with the conveyor being positioned by actuator 32 in an intermediate position for receipt of parts, a lowered position for rinsing, a return to the intermediate position for drainage of solution and a raised position for discharge from the plating system.

It can be appreciated from reference to FIG. 1 that the parts are fully immersed in solution and tumbled while being plated. Because free, unrestricted circulation of solution is effected, plating is extremely efficient. A much lower voltage drop from anode to cathode results. In comparison with prior art barrel platers which require proportionally higher voltages at the anode to have the necessary voltage at the parts to achieve plating, the present invention permits a substantially lower voltage at the anode. Because of lower voltages anode oxidation and destruction is retarded and while at the same time achieving faster plating. Because of the tumbling action, all surfaces of the parts are plated with a uniform layer of plating material.

What is claimed:

1. A method of surface treatment of parts with liquid baths comprising the steps of:

(a) cleaning said parts in a first treatment tank;

(b) transferring said cleaned parts by first conveyor means to a second conveyor means;

(c) next immersing said parts transferred to said second conveyor means in a treatment tank containing a liquid bath of treatment solution and tumbling said parts on said second conveyor means within said liquid bath;

(d) transferring said tumbled parts out of said treatment tank by said second conveyor means and onto a third conveyor means in a rinse tank containing rinsing solution and subjecting the parts on said third conveyor to a rinsing action utilizing said rinsing solution;

(e) allowing the parts on said third conveyor to drain;

(f) recapturing the drained solution within said rinse tank; and (g) discharging the parts on said third conveyor from said rinse tank.

2. A method according to claim 1, wherein the parts are tumbled on said third conveyor during said rinse operation.

3. A method according to claim 2, further comprising providing said second conveyor means with a porous support surface for said parts for drainage of treatment solution from said parts following tumbling within said bath.

4. A method according to claim 3, further comprising providing said third conveyor means with a porous support surface for said parts.

* * * * *